US010378831B2

(12) United States Patent
Ling et al.

(10) Patent No.: US 10,378,831 B2
(45) Date of Patent: Aug. 13, 2019

(54) COUNTER-FLOW FIN PLATE HEAT EXCHANGER FOR GAS-GAS HEAT EXCHANGE

(71) Applicant: NANJING TECH UNIVERSITY, Nanjing (CN)

(72) Inventors: Xiang Ling, Nanjing (CN); Yu Yang, Nanjing (CN); Hao Peng, Nanjing (CN); Rui Li, Nanjing (CN)

(73) Assignee: NANJING TECH UNIVERSITY, Nanjing (CN)

( * ) Notice: Subject to any disclaimer, the term of this patent is extended or adjusted under 35 U.S.C. 154(b) by 0 days.

(21) Appl. No.: 16/087,104

(22) PCT Filed: Mar. 6, 2017

(86) PCT No.: PCT/CN2017/075708
§ 371 (c)(1),
(2) Date: Sep. 21, 2018

(87) PCT Pub. No.: WO2017/162018
PCT Pub. Date: Sep. 28, 2017

(65) Prior Publication Data

US 2019/0101339 A1 Apr. 4, 2019

(30) Foreign Application Priority Data

Mar. 24, 2016 (CN) ..... 2016 1 0170952

(51) Int. Cl.
*F28F 3/02* (2006.01)
*F28D 21/00* (2006.01)
(Continued)

(52) U.S. Cl.
CPC ..... *F28F 3/025* (2013.01); *F28D 9/00* (2013.01); *F28D 9/0025* (2013.01);
(Continued)

(58) Field of Classification Search
CPC ..... F28F 3/025; F28F 9/00; F28F 9/18; F28F 2215/00; F28F 2220/00; F28F 2250/106;
(Continued)

(56) References Cited

U.S. PATENT DOCUMENTS 2,611,586 A * 9/1952 Collins ..... F28F 1/42 165/140
4,442,886 A * 4/1984 Dinulescu ..... F28D 9/0037 165/76

(Continued)

FOREIGN PATENT DOCUMENTS

CN 102269420 A 12/2011
CN 104251634 A 12/2014

(Continued)

*Primary Examiner* — Joel M Attey
(74) *Attorney, Agent, or Firm* — Gokalp Bayramoglu

(57) ABSTRACT

A counter-flow fin plate heat exchanger for gas-to-gas heat exchange includes several outer channel fins, an outer channel bending plate, an inner channel fin and an inner channel bending plate. The outer channel bending plate is a flat plate with two sides bending upward vertically. The inner channel bending plate is a cuboid box without a cap on the top, and the top of the inner channel bending plate is hermetically fixed with the bottom of the outer channel bending plate. The several outer channel fins are arranged in parallel inside the outer channel bending plate. The inner channel fins are arranged inside the inner channel bending plate. Ends of a side surface corresponding to two long sides of the inner channel bending plate are respectively provided with an opening, and the two openings are respectively disposed at different ends of the two side surfaces.

9 Claims, 6 Drawing Sheets

(51) Int. Cl.
*F28D 9/00* (2006.01)
*F28F 9/18* (2006.01)
*F28F 9/00* (2006.01)

(52) U.S. Cl.
CPC ..... *F28D 21/0003* (2013.01); *F28F 9/00* (2013.01); *F28F 9/18* (2013.01); *F28D 9/0006* (2013.01); *F28D 9/0093* (2013.01); *F28D 2021/0022* (2013.01); *F28F 2215/00* (2013.01); *F28F 2220/00* (2013.01); *F28F 2250/106* (2013.01); *F28F 2275/06* (2013.01)

(58) Field of Classification Search
CPC ..... F28F 2275/06; F28D 9/00; F28D 9/0025; F28D 21/0003; F28D 2021/022; F28D 9/0037; F28D 9/0075; F28D 9/0081; F28D 9/0093; F28D 9/0006
USPC ..... 165/166
See application file for complete search history.

(56) References Cited

U.S. PATENT DOCUMENTS

| | | | | |
|---|---|---|---|---|
| RE33,912 E * | 5/1992 | Lapkowski | F28D 9/0037 | 165/164 |
| 6,357,396 B1 * | 3/2002 | Stansfield | F24D 12/02 | 122/7 R |
| 2017/0131042 A1 * | 5/2017 | Fujita | F28D 9/0062 | |

FOREIGN PATENT DOCUMENTS

| | | |
|---|---|---|
| CN | 104567488 A | 4/2015 |
| CN | 105157456 A | 12/2015 |
| CN | 105806109 A | 7/2016 |

* cited by examiner

COUNTER-FLOW FIN PLATE HEAT EXCHANGER FOR GAS-GAS HEAT EXCHANGE

CROSS REFERENCE TO RELATED APPLICATIONS

This application is the national phase entry of International Application No. PCT/CN2017/075708, filed on Mar. 6, 2017, which is based upon and claims priority to Chinese Patent Application No. 201610170952.7, filed on Mar. 24, 2016, the entire contents of which are incorporated herein by reference.

TECHNICAL FIELD

The invention relates to a heat exchanger, in particular to a counter-flow fin plate heat exchanger for gas-to-gas heat exchanger.

BACKGROUND

The steel industry and the chemical industry are the basic industries in China. The exhaust temperatures of many industrial heating furnaces and gas-fired oil-fired boilers in these industries are above 150° C. The sensible heat of the smoke and the latent heat of the vaporization of the water vapor are very large. Direct emissions not only greatly waste energy, but also increase pollutant emissions. At the same time, the energy utilization rate of some steel industries is only 30-50%. A large amount of waste heat is wasted in the production process, which can be reasonably recycled, and used to increase the temperature of the combustion-supporting air or gas to generate steam for power generation, daily heat supply and so on. As the energy demand continuously increases in China's modern industry, the importance of the waste heat recovery is increasing day by day. How to efficiently recycle waste heat has become a hot issue of energy conservation and emission reduction.

The heat exchanger is the core component of the waste heat recovery system. It is of great significance on the development of the waste heat recovery to improve the heat transfer performance of the heat exchange. The heat exchangers can be classified as the tubular heat exchangers, the plate heat exchangers, the heat pipe heat exchangers and the panel heat exchangers. Compared to the conventional tubular heat exchangers, the plate heat exchangers and the panel heat exchangers achieve enhanced heat transfer through the shape and surface structure of the heat exchange components.

In the process of the waste heat recovery, as the temperature of the flue gas decreases, the resistance drop of the heat exchanger and the possible scaling and corrosion phenomena are one of the important factors hindering the development of the waste heat recovery system. At present, in the field of the waste heat recovery, the traditional tubular, finned tube and plate heat exchangers occupy a large installation space and have poor corrosion resistance due to the large amount of heat recovered from the flue gas.

SUMMARY

The technical problem to be solved by the present invention is to provide a counter-flow fin plate heat exchanger for gas-to-gas heat exchange. The counter-flow fin plate heat exchanger for gas-to-gas heat exchange has small side resistance of the flue gas, is not easy to accumulate ash, and can effectively prevent dew point corrosion.

In order to solve the above technical problems, the technical solution adopted by the present invention is:

A counter-flow fin plate heat exchanger for gas-to-gas heat exchange, characterized in that a plurality of sets of counter-flow fin plates are stacked and fixed in the thickness direction to form a heat exchange unit. Two air channels are fixed on both sides of the heat exchange unit, and are respectively connected with the bending plate side opening of the inner channel of the counter-flow fin plate on both sides of the heat exchange unit. A plurality of heat exchange units are laterally stacked and fixed to form a set of heat exchange units. A plurality of sets of heat exchange unit are stacked in the vertical direction. The adjacent sets of heat exchange unit are connected by a flue gas channel. The outsides of the plurality of sets of the heat exchange unit are fixed by a support frame. A heat exchanger housing is arranged outside the support frame. The air flows along the air channel in the heat exchanger in an S shape.

Further, the heat exchanger housing includes an air inlet sealing cap, an air side sealing cover, an air inlet side sealing plate, a sealing plate, a flue gas inlet flange, an air outlet sealing cap, an air outlet side sealing plate, a heat exchanger core and a flue gas outlet flange. The air inlet side sealing plate, the sealing plate and the air outlet side sealing plate form a hollow cuboid, and are fixed on the outside of the support frame. The flue gas inlet flange and the flue gas outlet flange are respectively fixed at the upper end and the lower end of the hollow cuboid. The air inlet side sealing plate and the air outlet side sealing plate respectively have a through hole corresponding to the opening position of the heat exchange unit. The air inlet sealing cap is fixed at the lower end of the air inlet side sealing plate and connected with the through hole at the lowermost end of the air inlet side sealing plate. The air outlet sealing cap is fixed at the upper end of the air outlet side sealing plate and connected with the through hole at the uppermost end of the air outlet side sealing plate. The air side sealing cover is fixed on the air inlet side sealing plate and connected to the adjacent two sets of through holes.

Further, the middle of the heat exchanger housing uses a corrugated or rectangular structure with variable diameters.

Further, the counter-flow fin plate includes a plurality of outer channel fins, an outer channel bending plate, an inner channel fin and an inner channel bending plate. The outer channel bending plate is a flat plate with two sides bending upward vertically. The inner channel bending plate is a cuboid box without a cap on the upper end, and the upper end of the inner channel bending plate is hermetically fixed with the lower end of the outer channel bending plate. A plurality of outer channel fins are arranged in parallel on the inside of the outer channel bending plate. The inner channel fins are arranged on the inside of the inner channel bending plate. Ends of a side surface corresponding to two long sides of the inner channel bending plate are respectively provided with an opening, and the two openings are respectively disposed at different ends of the two side surfaces.

Further, two ends of the outer channel bending plate and the inner channel bending plate are respectively provided with a flow guiding structure.

Further, the flow guiding structure is a flow deflector.

Further, the flow guiding structure is a spherical crown. The spherical crowns are distributed interlacedly. The space between the two spherical crowns is 2 to 4 times the diameter of the bottom circle of the spherical crown. The diameter of the bottom circle of the spherical crown is less than 2 times the space between the fins.

Further, the bending height of the outer channel bending plate is 0.5-1 mm more than the heights of the plurality of outer channel fins. The height of the side of the inner channel bending plate is 0.5-1 mm more than the height of the inner channel fin.

Further, the sum of the length of the side opening of the inner channel bending plates and the distance between the opening and the side end of the inner channel bending plates is ⅛-⅙ of the total length of the inner channel bending plates.

Further, the inner channel fins and the outer channel fins are flat sawtooth-shaped, triangular or porous fins.

Compared with the prior art, the present invention has the following advantages and effects:

1. The heat exchanger has small side resistance of the flue gas, is not easy to accumulate dust and can effectively prevent dew point corrosion.

2. The heat exchanger is assembled by a plurality of heat exchange units, which is convenient to install and disassemble, compact in structure, simple to manufacture and install, and has high heat exchange efficiency.

3. The equipment cost is low. The new parallel connection and series connection, the assembly method combining the sealing plate and the support frame, and the efficient heat exchange structure is adopted, which is suitable in the large waste heat recovery systems.

DETAILED DESCRIPTION OF THE EMBODIMENTS

Figure 1:
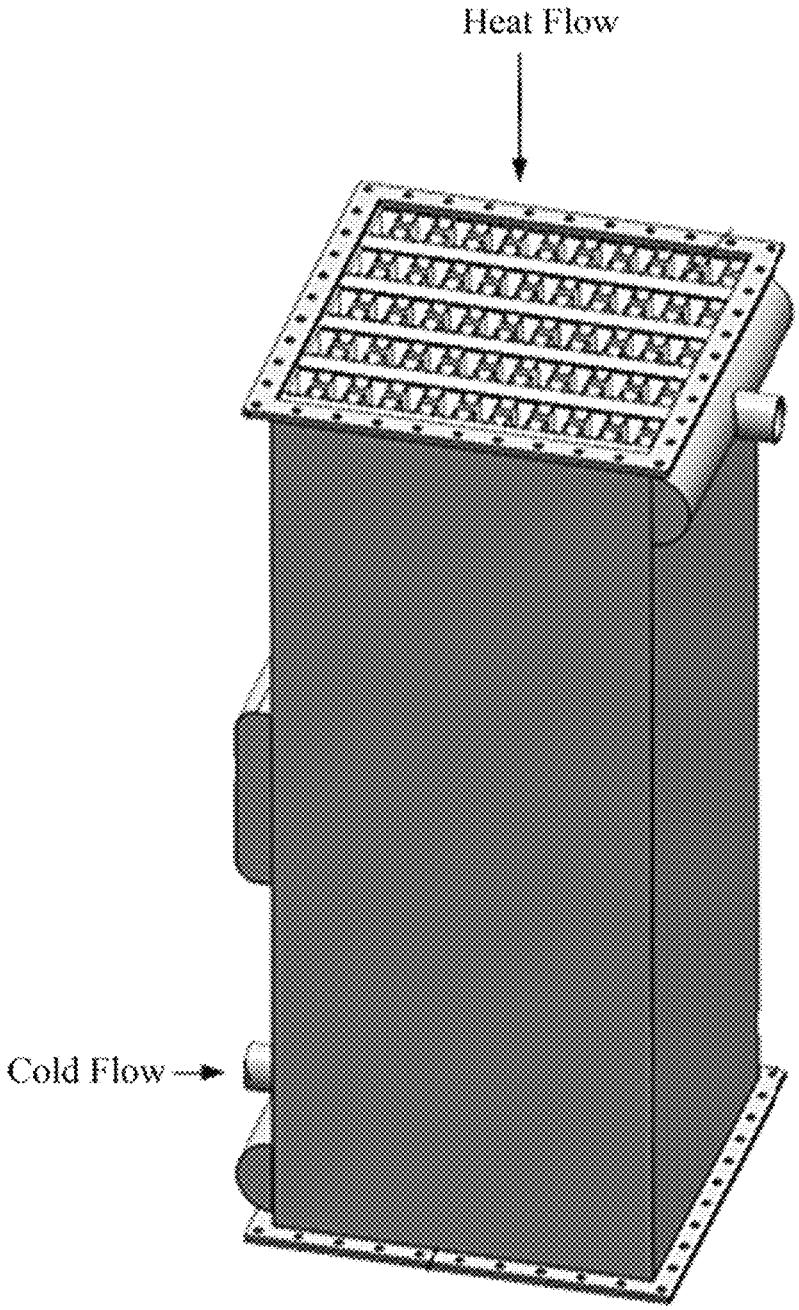
FIG. 1 is an outline view of a heat exchanger of the present invention.
Figure 2:
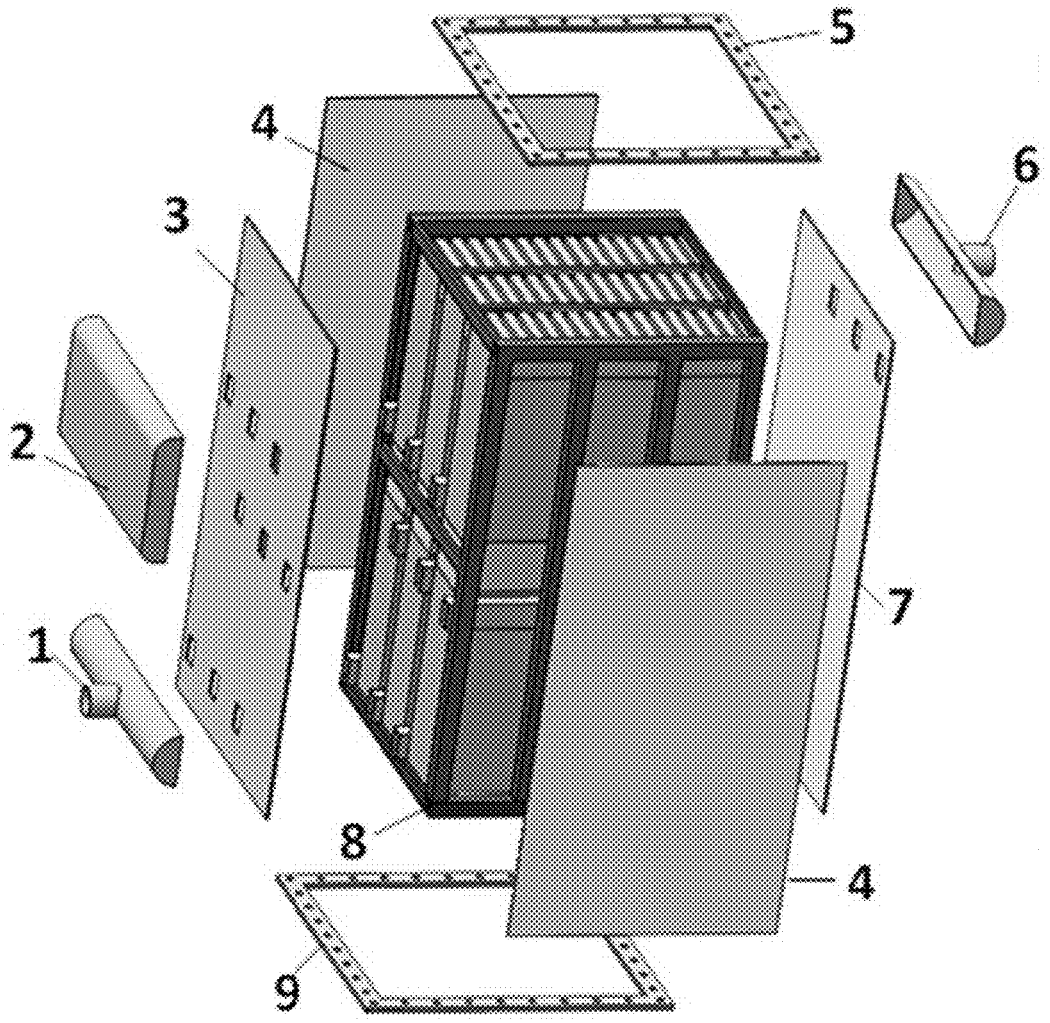
FIG. 2 is an exploded view of a heat exchanger of the present invention.
Figure 3:
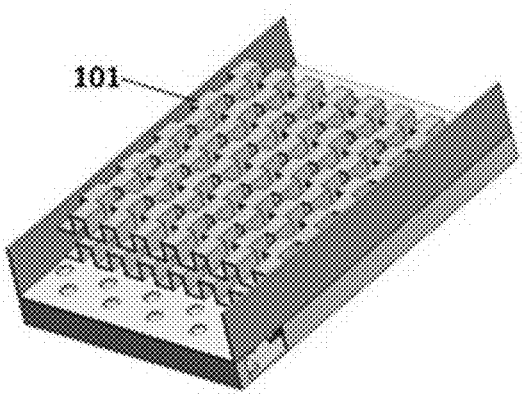
FIG. 3 is a schematic diagram of a counter-flow fin plate of the present invention.
Figure 4:
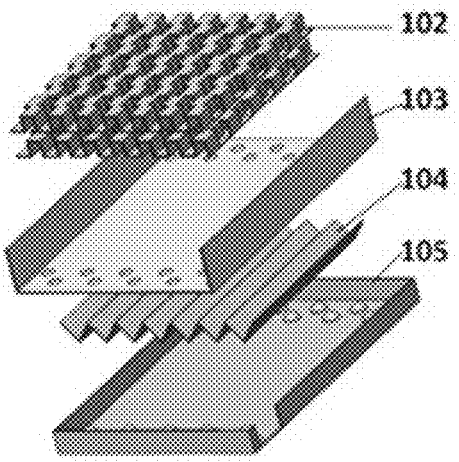
FIG. 4 is an exploded view of a counter-flow fin plate of the present invention.
Figure 5:
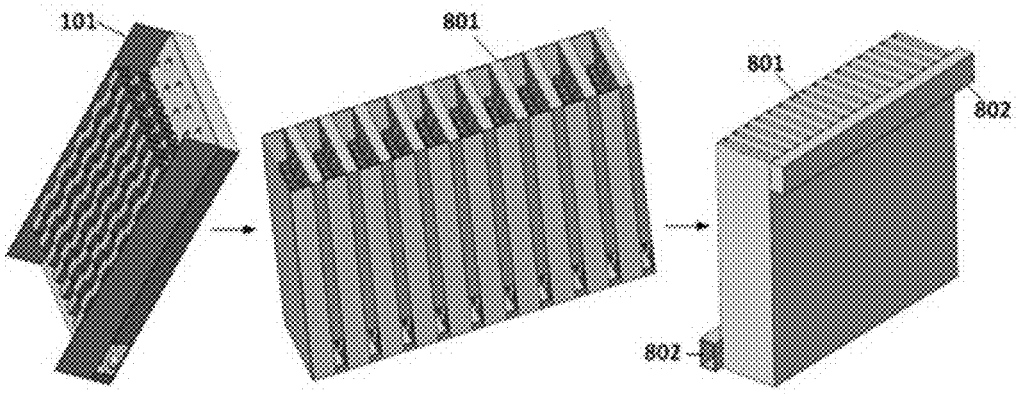
FIG. 5 is a schematic diagram of a heat exchange unit of the present invention.
Figure 6:
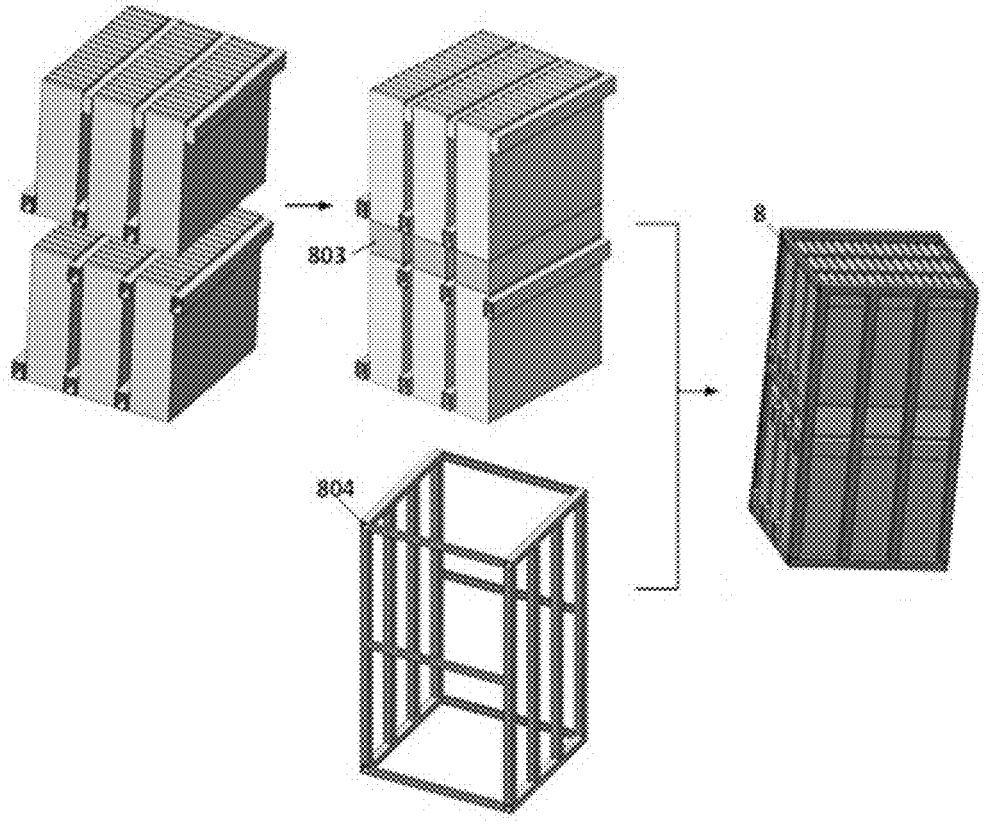
FIG. 6 is a schematic diagram of a heat exchanger assembly of the present invention.
Figure 7:
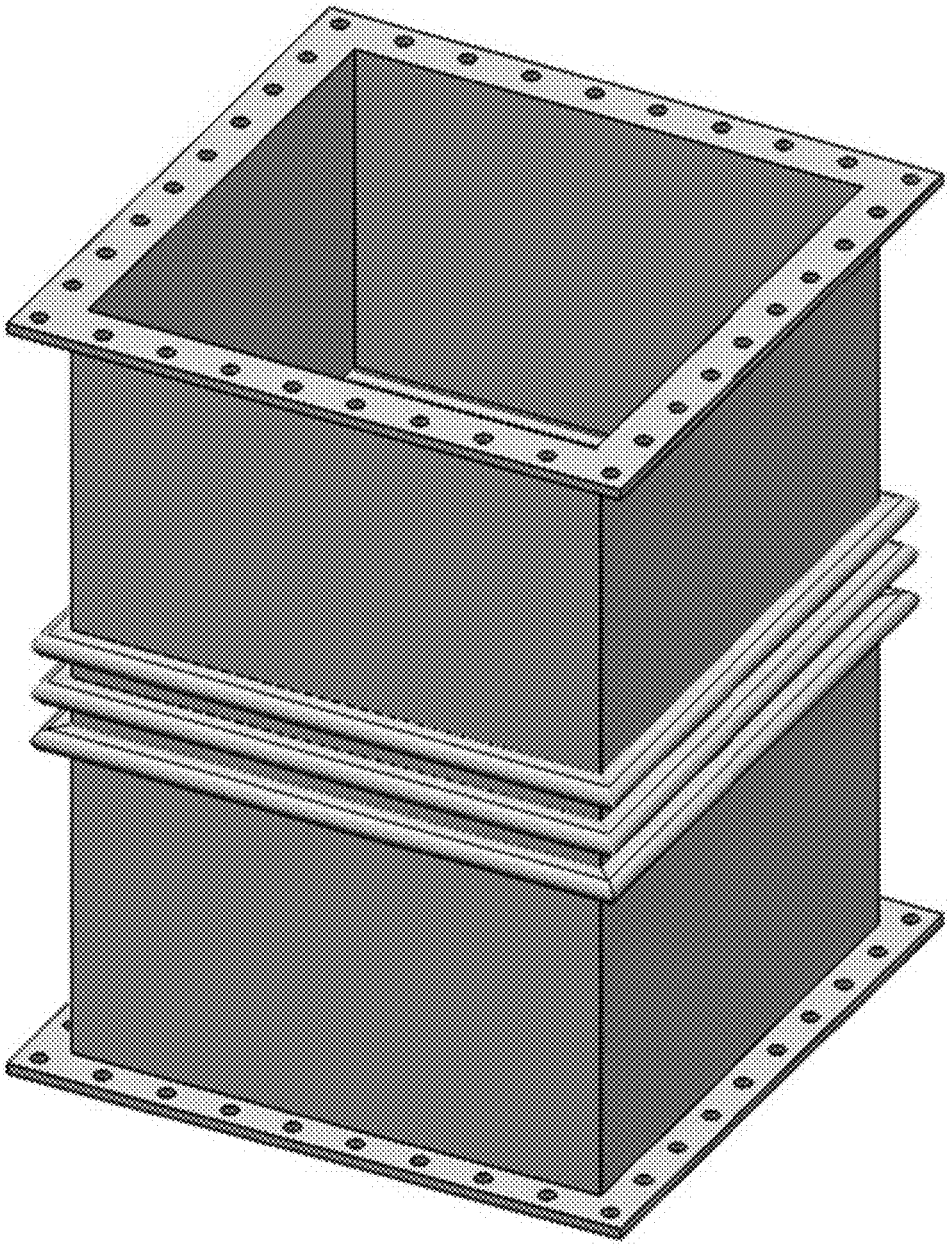
FIG. 7 is a schematic diagram of a heat exchanger housing of the present invention.

The present invention will be further described in detail below with reference to drawings through the embodiments. The following embodiment explains the present invention, and the present invention is not limited to the following embodiment.

The heat exchanger of the present invention is mainly composed of a heat exchanger housing, an outer component and a heat exchanger core. The flue gas flows from the top to the bottom, and exchanges heat with the air entering from the side. The two heat exchange media flow in a counter-current mode.

A counter-flow fin plate heat exchanger for gas-to-gas heat exchange is provided. A plurality of sets of counter-flow fin plates are stacked and fixed in a thickness direction to form heat exchange unit 801. Two air channels 802 are fixed on both sides of the heat exchange unit and respectively connected to the side opening of the inner channel bending plate of the counter-flow fin plates on both sides of the heat exchange unit 801. A plurality of heat exchange units 801 are laterally stacked and fixed to form a set of heat exchange units. A plurality of sets of heat exchange units are stacked in a vertical direction, and the adjacent sets of heat exchange units are connected by the flue gas channels 803. The outsides of the plurality of the sets of heat exchange units are fixed by the support frame 804. Heat exchanger housing is provided outside the support frame. The air in the heat exchanger flows along the air channel 802 in an S shape. The heat exchanger units 801 are assembled in layers from bottom to top, and each layer is composed of a plurality of heat exchange units. Generally, the number in a set of heat exchange units is between 1 to 5, and 1 to 4 sets of heat exchange units are arranged from top to bottom. The amount of the heat exchange units 801 can be changed according to the requirements of heat exchange. Air channels 802 are formed by welding on both sides of the heat exchange unit 801 so that the air can flow into and out of the plurality of fin plates 101 from the air channel 802. The heat exchange units 801 in the upper layer and the lower layer are welded in series by the flue gas channels 803 one by one. The support frame 804 is welded with the contact portion of the heat exchange 801 and the air channel 802 through the channel steel and the square steel made of 304 stainless steel. The support frame 804 mainly supports the core and serves as a skeleton to facilitate the welding of the heat exchanger housing. After the support frame 804 is assembled, the heat exchanger housing is welded. Finally, the sealing plate 4 of the heat exchanger housing and other external members are sequentially welded. According to the different temperature distribution of the heat exchanger, if two sets of the heat exchange units in the upper layer and the lower layer are used, and the temperature of flue gas decreases from the higher temperature to below the dew point temperature, the fin plate of the upper heat exchange unit can adopt the Nickel-based brazing, and the fin plate of the lower heat exchange unit can adopt the Copper-based brazing. If multiple layers of fins are used on the bending plate, the distance between adjacent fins is 2-6 mm, which can ensure the heat exchange performance and resistance of the flue gas side.

The heat exchanger housing includes the air inlet sealing cap 1, the air side sealing cover 2, the air inlet side sealing plate 3, the sealing plate 4, the flue gas inlet flange 5, the air outlet sealing cap 6, the air outlet side sealing plate 7, the heat exchanger core 8 and the flue gas outlet flange 9. The air inlet side sealing plate 3, the sealing plate 4 and the air outlet side sealing plate 7 constitute a hollow cuboid and are fixed outside the support frame 804. The flue gas inlet flange 5 and the flue gas outlet flanges 9 are respectively fixed on the upper end and the lower end of the hollow cuboid. The air inlet side sealing plate 3 and the air outlet side sealing plate 7 have through holes corresponding to the open positions of the heat exchange unit. The air inlet sealing cap 1 is fixed in the lower end of the air inlet side sealing plate 3 and connected with the through hole at the lowermost end of the air inlet side sealing plate 3. The air outlet sealing cap 6 is fixed at the upper end of the air outlet side sealing plate 7 and connected with the through hole at the uppermost end of the air outlet side sealing plate 7. The air side sealing cover 2 is fixed on the air inlet side sealing plate 3 and connected with the adjacent two sets of through holes. The air inlet side sealing plate 3, the sealing plate 4 and the air outlet side sealing plate 7 adopt submerged-arc welding and are welded around the heat exchanger core 8.

The flue gas flows from the flue gas inlet flange 5 into the heat exchanger core 8, and flows out from the flue gas outlet flange 9. The air enters from the air inlet sealing cap 1, and flows into the heat exchange unit 801 through the air channels 802 in the lower layer. Then the air interflows in series can be achieved through the air side sealing cover 2, and the air flows out through the heat exchange unit 801 in the upper layer. Finally the heated air is transferred outward through the air outlet sealing cap 6. The middle of the heat exchanger housing uses a corrugated or rectangular structure with variable diameters to avoid a deformation caused by thermal expansion of the heat exchanger when operating at a high temperature. The material of the entire heat exchanger is 304 stainless steel or 316L stainless steel. The airtightness test is required after the entire heat exchanger is completed. The surfaces of the bending plates and the fins of the fins plate are treated by a sputtering technique, which greatly improves the corrosion resistance of the heat exchanger and prolongs the service life of the heat exchanger.

The counter-flow fin plate includes a plurality of outer channel fins 102, an outer channel bending plates 103, an inner channel fins 104 and an inner channel bending plate 105. The outer channel bending plate 103 is a flat plate with two sides bending vertically upward. The inner channel bending plate 105 is a cuboid box without a cap on the upper end. The upper end of the inner channel bending plate 105 is hermetically fixed to the lower side of the outer channel bending plate 103. A plurality of outer channel fins 102 are disposed in parallel inside the outer channel bending plate 103. The inner channel fins 104 are disposed inside the inner channel bending plate 105. The ends of the side surface corresponding to the two long sides of the inner channel bending plate 105 are respectively provided with an opening, and the two openings are respectively disposed at different ends of the side surfaces. The outer channel fin 102 is disposed inside the bending plate 103, through which the flue gas flows. The inner channel fin 104 is disposed inside the bending plate 105, from which air flows away. The amount of fin layers can be determined according to the heat exchange effect, and the shape of the fin can be changed according to requirements. The bending plate 103 and the bending plate 105 are bent, wherein after the bending plate 105 is bent, the sides are welded to each other; the bending height h is 0.5-1 mm more than the height of the corresponding fin. The sum of the length of opening 12 at the fluid inlet of the bending plate 105 and the length 11 from the edge of the bending plate is ⅛-⅙ of the length L of the bending plate; the length 11 should not be too short, and may be 30 to 50 mm. The bending plate 103 and the bending plate 105 adopt a flow deflector or a stamping spherical crown as a flow guiding structure, wherein the spherical crowns are interlacedly distributed on the bending plate 103 and the bending plate 105; the distance between two spherical crowns is 2 to 4 times the diameter of the bottom circle of the spherical crown; and the diameter of the bottom circle of the spherical crown is less than 2 times the space between the fins. The adjacent fin plates 101 are welded by an argon arc welding process. The fin plate 101 is formed by a connecting technique for the bending plate, which simplifies the manufacturing process, reduces the welding points, and thereby reduces the welding stress and the missing points. A plurality of fin plates 101 are welded to form heat exchange unit 801. The amount of fin plates 101 is determined according to heat exchange requirements. After each heat exchange unit 801 is welded, an airtightness test and a hydrostatic test are performed in the inner channels to ensure the airtightness and the pressure resistance of the inner channels of the fin plates 101 and to examine the welding quality between the fin plates 101.

The inner channel fins and the outer channel fins of the fin plate can be flat, sawtooth-shaped, triangular or porous fins, and the fins can be multiple layers. If the flue gas contains a small number of suspended solids, the sawtooth-shaped fins are adopted as the outer channel fins to enhance heat exchange and facilitate moisture evaporation. If the flue gas contains a large number of suspended solids, the flat or porous fin can be adopted to effectively prevent the adhesion of particles and moisture, thus avoiding clogging up of the flue with particles. As an optimization, the height of the outer fin is more than or equal to 6 mm, which can effectively prevent scaling. Two-layer triangular fins with a type of 90SJ6002 are adopted as a plurality of outer channel fins. The sawtooth-shaped fins with a type of 12JC4002 are adopted as inner channel fins.

A counter-flow fin plate heat exchanger for gas-to-gas heat exchange reduces a flue gas temperature of a furnace to below 180° C. The design conditions are: the temperature of the flue gas with a mass flow of 9.83 kg/s is reduced from 320° C. to 170 C; the air with a mass flow of 8.63 kg/s is preheated from 67 C to 260° C.; and the pressure drop of the flue gas side and the air side are not less than 0.4 kPa and 0.5 kPa, respectively. The composition of the flue gas is shown in Table 1 below.

TABLE 1 the composition of the flue gas

| | Composition | | | | |
|---|---|---|---|---|---|
| | $CO_2$ | $H_2O$ | $O_2$ | $N_2$ | $SO_2$ |
| Volume fraction | 15.3% | 12.7% | 2.2% | 69.8% | 2.85 ppm |

After calculation, two-layer triangular fins with a type of 90SJ6002 are adopted in the flue gas side, and one-layer sawtooth-shaped fins with a type of 12JC4002 are adopted in the air side. The bent plate 103 and the bent plate 105 respectively have a thickness of 1.2 mm, a height of 21.2 mm and 13.2 mm, and a length of 1000 mm. The fin plate 101 has an effective length (with fins) of 400 mm. The amount of the heat exchange unit is six, and each heat exchange unit 801 contains 70 fin plates 101. After being assembled according to the specific embodiment, the total size of the counter-flow fin plate heat exchanger for flue gas waste heat recovery of the present embodiment is 5600 mm×2900 mm×4770 mm. Among them, the space between the lateral heat exchange units is 164 mm, and the longitudinal space (height of the flue gas channel) is 300 mm. In order to meet the strength requirements of the heat exchanger, the channel steel with a size of 160 mm×65 mm×8.5 mm and the equal leg angle with a size of 60 mm×6 mm are adopted in the support frame 801. The heat exchanger can recycle a heat of 1690 kW.

The above description in this specification is merely illustrative embodiment of the invention. A person skilled in the art can make various modifications or additions to the described specific embodiments or replace them in a similar manner, as long as they do not deviate from the content of the specification or beyond the scope defined by the claims, which belongs to the protective scope of the present invention.

The invention claimed is:

1. A counter-flow fin plate heat exchanger for gas-to-gas heat exchange, comprising: a plurality of sets of counter-flow fin plates are stacked and fixed in a thickness direction to form a heat exchange unit; two air channels are fixed on the heat exchange unit and are respectively connected with one on each side of the heat exchange unit and one of each connected with one of two side openings on an inner channel bending plate of the counter-flow fin plate on both sides of the heat exchange unit; a plurality of heat exchange units are laterally stacked and fixed to form a set of heat exchange units; a plurality of sets of heat exchange units are stacked in the vertical direction; adjacent sets of heat exchange units are connected by a flue gas channel; outsides of the plurality of sets of the heat exchange units are fixed by a support frame; a heat exchanger housing is arranged outside the support frame; air flows along the air channel in the heat exchanger in an S shape.

2. The counter-flow fin plate heat exchanger for gas-to-gas heat exchange according to claim 1, wherein the heat exchanger housing comprises an air inlet sealing cap, an air side sealing cover, an air inlet side sealing plate, a pair of sealing plates, a fine gas inlet flange, an air outlet sealing cap, an air outlet side sealing plate, a heat exchanger core and a fine gas outlet flange; the air inlet side sealing plate, the pair of sealing plates and the air outlet side sealing plate form a hollow cuboid and are fixed on an outside of the support frame; the flue gas inlet flange and the flue gas outlet flange are respectively fixed at an upper end and a lower end of the hollow cuboid; the air inlet side sealing plate and the air outlet side sealing plate respectively have a through hole corresponding to an opening position of the heat exchange unit; the air inlet sealing cap is fixed at a lower end of the air inlet side sealing plate and connected with the through hole at a lowermost end of the air inlet side sealing plate, the air outlet sealing cap is fixed at an upper end of the air outlet side sealing plate and connected with the through hole at an uppermost end of the air outlet side sealing plate; the air side sealing cover is fixed on the air inlet side sealing plate and connected to adjacent, two sets of through holes.

3. The counter-flow fin plate heat exchanger for gas-to-gas heat exchange according to claim 1, wherein the counter-flow fin plate comprises a plurality of outer channel fins, an outer channel bending plate, an inner channel fin and an inner channel bending plate; the outer channel bending plate is a flat plate with two sides bending upward vertically; the inner channel bending plate is a cuboid box without a cap on an upper end of the inner channel bending plate, and the upper end of the inner channel bending, plate is hermetically fixed with a lower end of the outer channel bending plate; the plurality of outer channel fins are arranged in parallel inside the outer channel bending plate; the inner channel fins are arranged inside the inner channel bending plate; a first side surface corresponding to a first long sides of the inner channel bending plate is provided with a first opening on an upper end of the first side surface, and a second long sides of the inner channel bending plate are provided with a second opening on a lower end of the second side surface.

4. The counter-flow fin plate heat exchanger for gas-to-gas heat exchange according to claim 3, wherein two ends of the outer channel bending plate and the inner channel bending plate are each respectively provided with one of a pair of flow guiding structures.

5. The counter-flow fin plate heat exchanger for gas-to-gas heat exchange according to claim 4, wherein each of the flow guiding structures is a flow deflector.

6. The counter-flow fin plate heat exchanger for gas-to-gas heat exchange according to claim 4, wherein each of the flow guiding structures is a plurality of spherical crowns; the spherical crowns of each plurlality are distributed interlacedly; a space between two spherical crowns of each plurality is 2 to 4 times a diameter of a bottom circle of an individual spherical crown of the plurality of spherical crowns; the diameter of the bottom circle of each individual spherical crown is less than 2 times a space between the outer channel fins.

7. The counter-flow fin plate heat exchanger for gas-to-gas heat exchange according to claim 3, wherein a bending height of the outer channel bending plate is 0.5-1 mm more than a height of the plurality of outer channel fins; a height of a side of the inner channel bending plate is 0.5-1 mm more than a height of the inner channel fin.

8. The counter-flow fin plate heat exchanger for gas-to-gas heat exchange according to claim 3, wherein a sum of a length of the side openings of the inner channel bending plate and a distance between the each side opening and a side end of the inner channel bending plate is ⅛-⅙ of a total length of the inner channel bending plate.

9. The counter-flow fin plate heat exchanger for gas-to-gas heat exchange according to claim 3, wherein the inner channel fin and the outer channel fins are flat fins, sawtooth-shaped fins, triangular fins or porous fins.

* * * * *